US012552504B2

(12) United States Patent
Aleixendri Munoz et al.

(10) Patent No.: US 12,552,504 B2
(45) Date of Patent: Feb. 17, 2026

(54) BOAT PROPULSION SYSTEM

(71) Applicant: BOUND 4 BLUE, S.L., Barcelona (ES)

(72) Inventors: Cristina Aleixendri Munoz, Barcelona (ES); Jose Miguel Bermudez Miquel, Barcelona (ES); David Ferrer Desclaux, Barcelona (ES)

(73) Assignee: BOUND 4 BLUE, S.L., Barcelona (ES)

( * ) Notice: Subject to any disclaimer, the term of this patent is extended or adjusted under 35 U.S.C. 154(b) by 547 days.

(21) Appl. No.: 18/011,125

(22) PCT Filed: Jun. 10, 2021

(86) PCT No.: PCT/ES2021/070425
§ 371 (c)(1),
(2) Date: Dec. 16, 2022

(87) PCT Pub. No.: WO2021/255306
PCT Pub. Date: Dec. 23, 2021

(65) Prior Publication Data
US 2023/0174209 A1 Jun. 8, 2023

(30) Foreign Application Priority Data
Jun. 19, 2020 (ES) ..... ES202030597

(51) Int. Cl.
*B63H 9/02* (2006.01)
*B63H 9/061* (2020.01)

(52) U.S. Cl.
CPC ..... *B63H 9/02* (2013.01); *B63H 9/061* (2020.02)

(58) Field of Classification Search
CPC ..... B63H 9/02; B63H 9/061
See application file for complete search history.

(56) References Cited

U.S. PATENT DOCUMENTS 2,713,392 A 7/1955 Von Karman et al.
4,398,895 A * 8/1983 Asker ..... B63H 9/02 416/4
4,582,013 A * 4/1986 Holland, Jr. ..... B63H 9/02 416/4
4,630,997 A 12/1986 Cousteau et al.

FOREIGN PATENT DOCUMENTS

ES 8306521 A1 11/1981
FR 2495242 A1 6/1982
FR 2847009 A1 5/2014
FR 3035861 A1 11/2016
WO 2014131873 A2 9/2014
WO 2021255306 A1 12/2021

OTHER PUBLICATIONS

International Search Report and Written Opinion for PCT/ES2021/070425, mailed Sep. 21, 2021, 12 pages.

* cited by examiner

*Primary Examiner* — Stephen P Avila
(74) *Attorney, Agent, or Firm* — Kutak Rock LLP

(57) ABSTRACT

The propulsion system for vessels comprises at least one suction sail (3), the at least one suction sail (3) comprises a suction system (10) and a transmission unit (8) to drive the rotation of the suction sail (3), wherein the suction sail (3) comprises at least two suction zones (7) arranged symmetrically on two sides of the suction sail (3), the suction zones (7) including suction holes. It provides a propulsion system for vessels that allows reducing their fuel consumption and polluting emissions by using an improved version of suction sails.

23 Claims, 7 Drawing Sheets

BOAT PROPULSION SYSTEM

This is the United States National Stage of Patent Cooperation Treaty Application No. PCT/ES2021/070425, filed Oct. 6, 2021, which claims priority to Spanish Patent Application No. 202030597, filed to the Spanish Patent and Trademark Office (SPTO) on Jun. 19, 2020, and entitled "BOAT PROPULSION SYSTEM", the disclosures of which are incorporated herein by reference in their entireties.

The present invention relates to a propulsion system for vessels, in particular to a propulsion system for vessels comprising one or more suction sails.

BACKGROUND OF THE INVENTION

Every vessel needs to generate forward power in order to navigate. The most widespread way of generating such power is through the use of systems that use hydrocarbons as an energy source. This entails two problems: the costs associated with fuel consumption and the polluting emissions derived from its use. This problem is of special relevance in merchant vessels linked to maritime transport, due to their large volume.

There are other technologies that take advantage of alternative energy sources that allow the generation of forward power, being able to complement or replace traditional methods based on hydrocarbons. This makes it possible to reduce the fuel consumption of vessels and, if the alternative energy source is also renewable, to reduce polluting emissions. One of these energy sources is the wind.

The wind assisted propulsion means of a vessel are known as WASP ("Wind Assisted Ship Propulsion"). There are several systems that can be considered as such (for example, sail, kite, "flettner" rotor, suction sail . . . ).

When the wind affects these WAPS, it generates a force perpendicular to the direction of the wind, called lift (L, Lift). In addition, an aerodynamic drag (D, Drag) is generated. Generally, these forces are expressed in a dimensionless way through the lift and drag coefficients:

$$C_L = \frac{L}{1/2\rho V^2 S} \quad C_D = \frac{D}{1/2\rho V^2 S}$$

On a vessel, the apparent wind can come from any direction. The direction of the apparent wind with respect to the path of the vessel (β) determines the use of the propulsive force of the WAPS through the following equation:

$$C_R = C_L sen\beta - C_D \cos\beta.$$

The $C_R$ is known as the driving force coefficient. It is observed that the lift and drag coefficients contribute through the values of the sine and cosine function in a different way for each path. The actions of a WAPS are therefore related to its aerodynamic characteristics, which are expressed as said lift and drag coefficients. It is observed that there is a dead or unusable zone that comprises an arc of a circle around the bow of about 15 degrees. The size of this unusable area depends, among other things, on the relationship between lift and drag coefficients.

The present invention refers to the improvement of the actions of a propulsion system composed of a thick profile with a rear spoiler or fin (known as "flap") and that includes a suction system that allows the suction of the boundary layer of the fluid around the sail, henceforth 'suction sail' or simply 'sail'. This propulsion system has its first antecedent in the Wind Motor (U.S. Pat. No. 2,713,392) and more specifically in the Turbovoile or Turbosail (U.S. Pat. No. 4,630,997A/FR2495242A1). These systems can be used as auxiliary propulsion systems, or if the type of vessel allows it, as primary propulsion systems. The usefulness of the system is not restricted to the propulsion of vessels but can be used as part of the profile of a wind turbine for energy production or any other application that requires a very large lift coefficient.

The main difference of the suction sail with respect to a traditional sail or a passive airfoil is that, thanks to the suction system that allows the suction of the boundary layer of the fluid, it is possible to control and delay the stalling of the profile, achieving a much higher lift coefficient. As the aerodynamic forces are proportional to the surface of the sail, a high lift coefficient makes it possible to reduce the area required to obtain the same global forces. As a result, there is a much more compact system or, alternatively, the number of sails on deck can be increased in the case of its application to vessels. In addition, it results in a device of potentially lower weight and cost, with less impact on a vessel's visibility requirements.

The suction sail, in operation, is similar to the wing of an airplane or the sails of a traditional sailing vessel. The wind, by hitting the sail, generates lift (L Lift) and aerodynamic drag (D Drag), thus generating a certain propulsive force.

The control of these aerodynamic forces is carried out by orienting the sail with respect to the incident wind (called angle of attack) as a traditional sail would do, in addition, by controlling the suction of the boundary layer.

The system produces positive returns if the net power developed by the sail is positive. This is influenced by the fact that the aerodynamic forces generate a positive propulsion power greater than the power consumed by the suction system. By analogy, a suction coefficient can be defined based on the power consumed:

$$C_a = P_{consumed}/0.5\rho V_3 S$$

The net propulsive power is the product of the speed of the vessel ($V_S$) by the propelling force. The propelling force depends on the squared wind speed ($V^2$), while the power consumed depends on the speed of the wind cubed ($V^3$). The net power can be expressed as:

$$P_{net} = \tfrac{1}{2}\rho V^2 S(V_S \cdot C_R - V \cdot C_R)$$

In the range of usable wind strengths, the vessel speed is typically less than the apparent wind speed; for almost all motor and sailing vessels. From the above equation it follows that to obtain a positive performance of the propulsion, the following must be met:

$$C_R > \frac{V}{V_S} C_a$$

This last equation reveals the multiplying effect on the suction coefficient of the speed ratio between the apparent speed and that of the vessel.

In the current state of the art, as described in the mentioned patents, the suction of the flow is carried out through a suction area. The suction is carried out through one or several fans located inside the body of the sail, with a tubular section and great thickness, which generate a uniform depression (or suction). This body serves as a suction chamber, through which the fluid is sucked. This means that the pressure is uniform throughout the body. The possibility of being able to vary the size of said suction area is mentioned, as well as the permeability of said suction areas with the height of the sail in order to adapt it to the wind speed gradient with height.

DISCLOSURE OF THE INVENTION

Therefore, an objective of the present invention is to provide a propulsion system for vessels that allows reducing their fuel consumption and polluting emissions by using an improved version of suction sails.

The objective of the present invention is the improvement of the net power through, on the one hand, the reduction of the suction coefficient ($C_a$), and, on the other, in the increase in lift and decrease in aerodynamic drag to increase the propulsive force coefficient ($C_R$), by performing a more precise control of the boundary layer and its suction.

The aim of the invention is to reduce the suction cost (Q) and the pressure jump (ΔP) required. An equivalent way of expressing the suction coefficient is by making use of these two variables and the efficiency of the compressor or fan ($\eta_{fan}$):

$$C_R = Q \cdot \Delta P / \eta_{fan}$$

In this way, by reducing the suction cost to the necessary minimum and configuring the suction system in such a way that the pressure jump is reduced, the suction coefficient can be reduced; or what is the same the power consumed.

The objective of the present invention is to improve the efficiency of suction sails by increasing the net propulsive power delivered, with respect to the current state of the art, by means of an optimized design of the suction system that allows the suction of the fluid boundary layer around the sail.

This optimized design allows for more precise control of the boundary layer and its suction, thereby achieving, on the one hand, a reduction in the suction coefficient ($C_a$), and, on the other, to increase the lift coefficient ($C_L$) and decrease the aerodynamic drag coefficient ($C_D$) to increase the propulsive force coefficient ($C_R$).

The reduction of the suction cost is achieved by selective suction of the flow in the right place. The flow around the profile must be vacuumed before it detaches from the surface. The suction is carried out through a porous surface that can take various forms: rows of holes, slots, channels, or any other form that allows the passage of fluid from the outside to the inside of the sail through suction.

The suction surface is not homogeneous but is adapted to the peculiarities of the flow at each point of the surface. At the beginning of the suction, the pressure in the extrados of the profile is the minimum on the suction surface. As the flow progresses downstream toward the flap, the pressure increases. In this way, by adjusting the suction pressure at each point of the profile, the total pressure jump at each point is minimal (ΔP). When this is combined with adequate porosity of the surface, the cost of suction (Q) is minimized.

The system that allows the selective suction of the flow can be considered as a pneumatic system. The suction is carried out through housings that communicate with the interior of the sail, through which there is an intermediate pressure drop. The housing consists of making an intermediate chamber around the suction area, in such a way that an intermediate suction chamber is created. This solution is indicated in the case of the use of one or more fans that pressurize the main chamber, through which the fluid of the external current is sucked.

Another possibility is the use of dedicated fans or compressors for each suction position. In this way, each fan, through a system of pipes, sucks the flow.

The suction can be extended beyond the body of the sail, by integrating dedicated fans in the flap. This allows flow suction on the flap, which substantially reduces the base drag and increases the lift coefficient. The energy costs of performing the suction in the flap are minimal since the pressure in that area is almost the ambient pressure and the power required to suck is minimal.

As the flap is mobile, the suction of the flap can be integrated into the body of the sail in such a way that, in each working position, the flap is connected to the body of the sail, which transfers suction capacity to it through the corresponding connections or pipes.

The propulsion system for vessels according to the present invention is defined in claim 1, and comprises a suction sail, said suction sail comprising a suction system and a transmission unit for driving the rotation of said suction sail, wherein the suction sail comprises at least two suction zones arranged symmetrically on two sides of the suction sail, said suction zones comprising variable suction means.

According to one embodiment, the variable suction means are holes in the suction zones of different dimensions from each other, or in other words, with different porosity.

According to one embodiment, the variable suction means comprise a housing in at least one of the suction zones, dividing each suction zone into sections.

Furthermore, if desired, at least one of the suction zones can be provided on the flap.

According to one embodiment, the or each suction zone arranged on the flap comprises a housing and/or a variable porosity.

The propulsion system for vessels according to the present invention may also comprise more than one suction system associated with different suction zones.

For example, each housing may be associated with a suction system.

According to one embodiment, the suction zone located on the flap comprises its suction system also located on the flap.

The propulsion system according to the present invention allows to provide, among others, the following advantages:

- Better control of the boundary layer suction (variable porosity, housings, multiple suction systems), minimizing unnecessary over-suction and, thus, reducing the necessary suction power consumption. This makes the sail more efficient, by generating more propulsive power for the vessel and, at the same time, reducing the power consumption of the sail.
- Extension of the suction and its variable control to the flap allows to delay even more the detachment of the flow by increasing the angle of attack and the asymmetry, thus allowing to increase the aerodynamic coefficients, and improving the performance of the sail.

BRIEF DESCRIPTION OF THE DRAWINGS

For better understanding of what has been disclosed, some drawings in which, schematically and only by way of a non-limiting example, a practical case of embodiment is shown.

In these figures, by way of simplification, only the suction zones of one of the two sides of the body of the sail and of the flap are shown. It should be understood that said suction zones will be symmetrical on both sides of the body and the flap.

DESCRIPTION OF PREFERRED EMBODIMENTS

Figure 1:
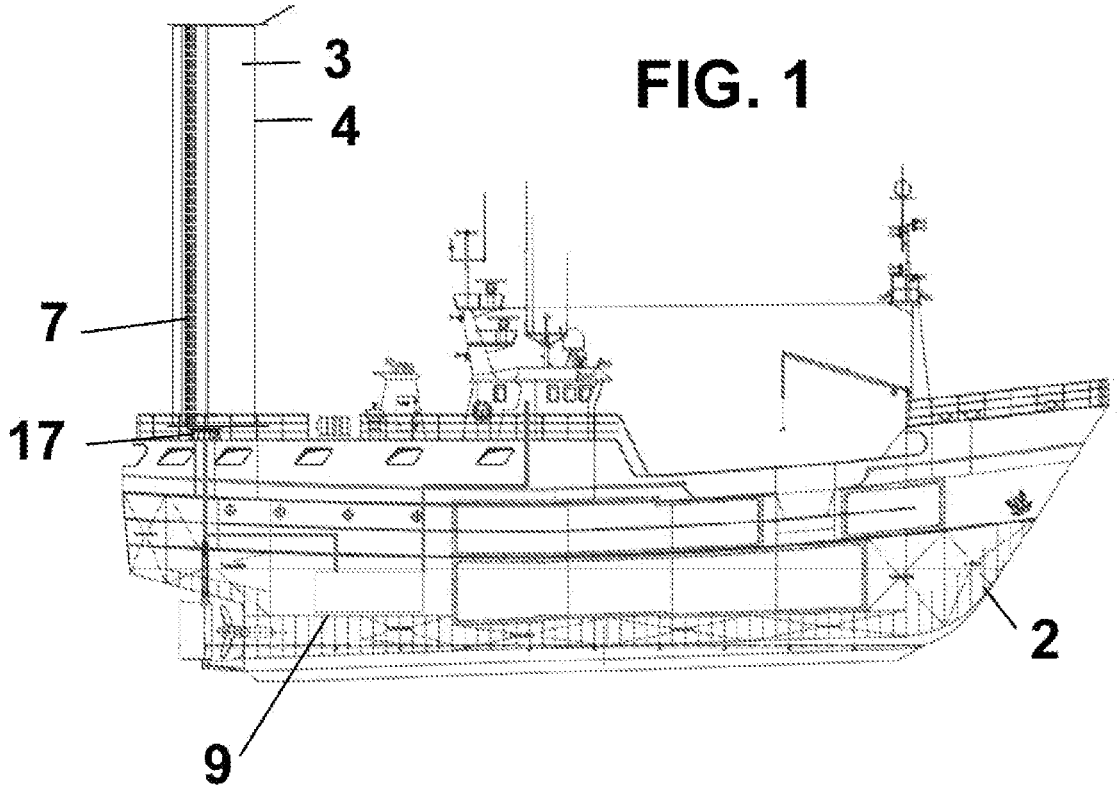
FIG. 1 is a side elevation view of a vessel incorporating the propulsion system according to the present invention.
Figure 2:
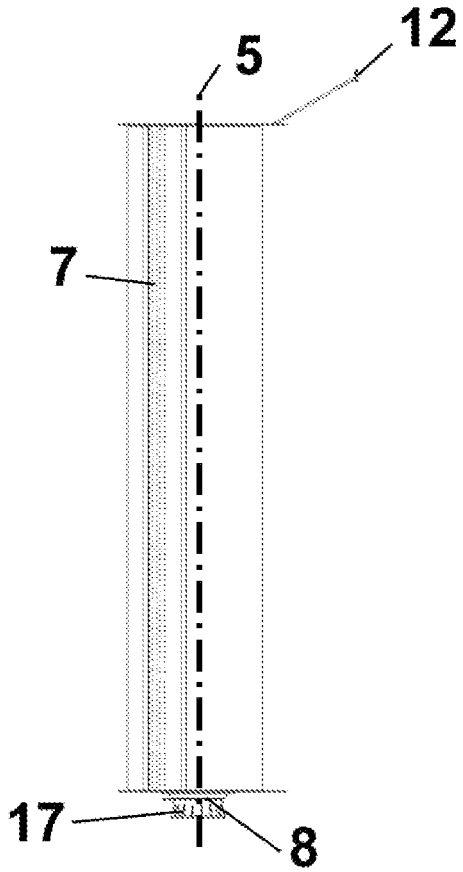
FIG. 2 is a side elevational view of a suction sail used in the propulsion system in accordance with the present invention.
Figure 3:
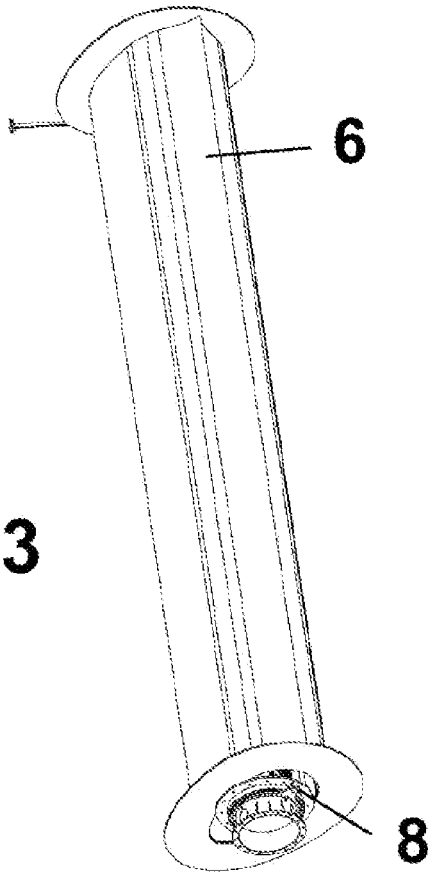
FIG. 3 is a bottom perspective view of a suction sail used in the propulsion system according to the present invention.
Figure 4:
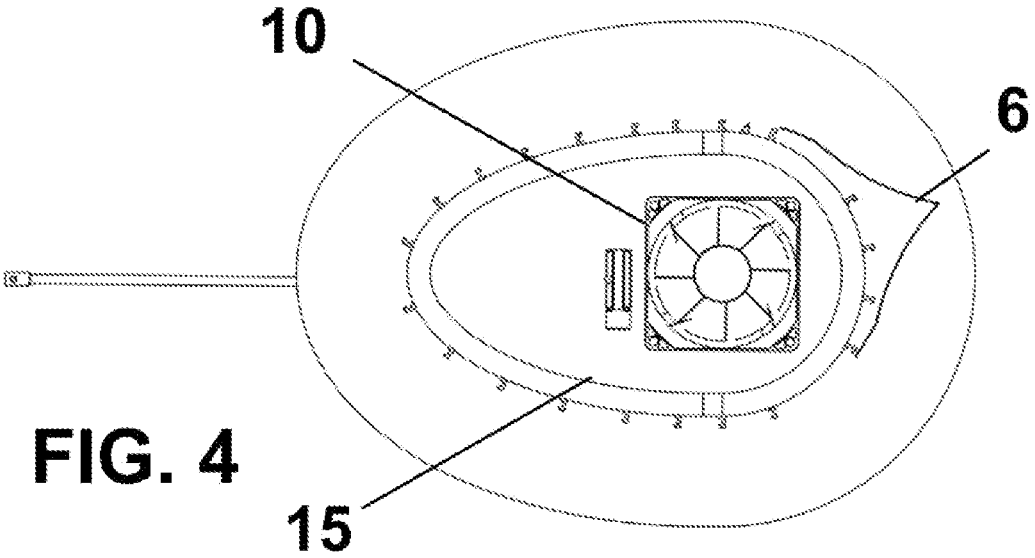
FIG. 4 is a top plan view of a suction sail used in the propulsion system according to the present invention, showing the suction system.
Figure 5:
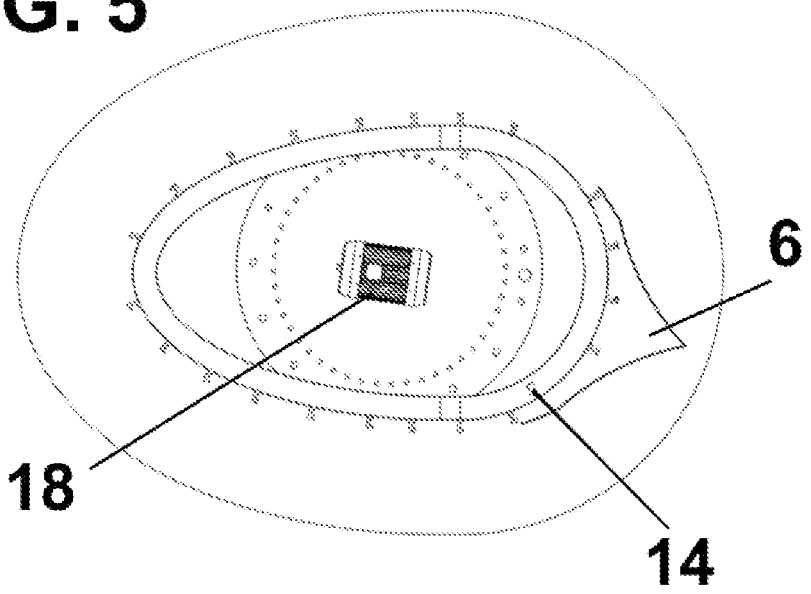
FIG. 5 is a sectional view of a suction sail used in the propulsion system according to the present invention, showing the transmission unit and the power unit.

FIG. 1 shows a vessel 2 comprising the propulsion system according to the present invention.

The propulsion system comprises at least one suction sail 3 that includes an outer covering 4, which can be rigid or flexible, and said suction sail 3 can rotate around its longitudinal axis 5.

The suction sail 3 also comprises at least one flap 6 capable of operating rotating among different positions and at least two equal and symmetrical suction zones 7 provided with multiple holes, with the suction zones 7 comprising variable suction means.

According to one embodiment, the variable suction is performed by varying the dimensions of the holes to each other in each suction zone 7, or in other words, by varying the porosity of the suction zone along it.

The suction sail 3 also comprises a suction system 10, which can be of the fan type or equivalent to suck part of the air flow from the extrados of the profile, and at least one transmission unit 8, which can be electric or hydraulic to rotate the suction sail 3 provided with an electric or hydraulic power unit 18, which drives said transmission unit 8.

Furthermore, the suction sail 3 is connected to the vessel deck 2 using a support structure 17, which may comprise a gear mechanism or a bearing structure, where the support structure 17 is capable of supporting the total weight and restrict the lateral movement of the suction sail 3.

Figure 6:
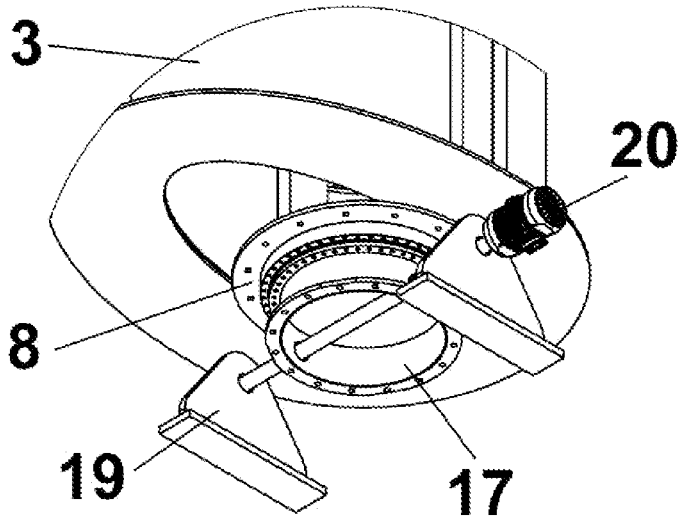
FIG. 6 is a view of the bottom of a suction sail used in the propulsion system of the present invention, according to an alternative embodiment, in which the suction sail is tiltable about a substantially horizontal axis.

FIG. 6 shows an alternative embodiment in which the lower part of the suction sail 3 comprises a tilting support 19, which allows the suction sail to tilt with respect to the vertical, that is, it tilts with respect to a substantially horizontal axis, driving a motor 20 or one or more cylinders.

Different embodiments of the suction sail are shown in FIGS. 7 to 14, differing from each other by the arrangement of the suction zones and/or by the means used to achieve variable suction control. In these figures, by way of simplification, only the suction zones of one of the two sides of the body of the sail and of the flap are shown. It should be understood that said suction zones will be symmetrical on both sides of the body and the flap.

Figure 7:
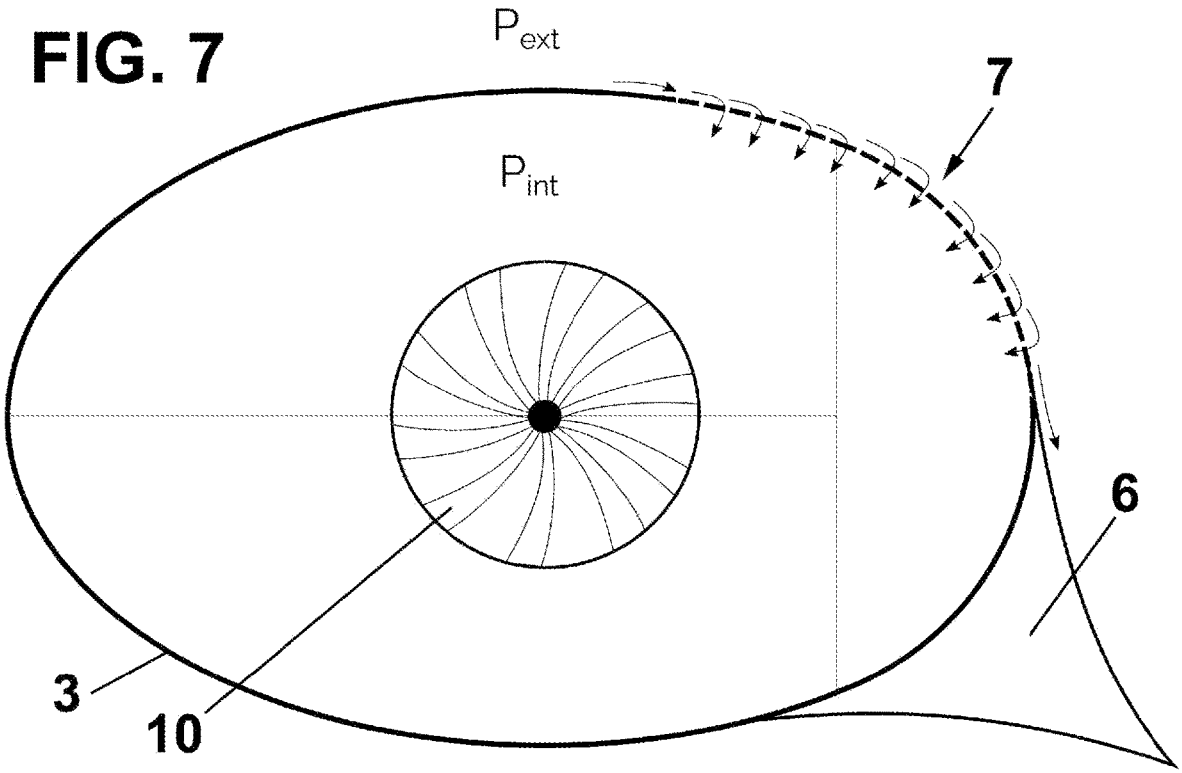
FIGS. 7 to 14 are cross-sectional views of different embodiments of the suction sail.

FIG. 7 shows a configuration comprising a single global suction zone 7, along which the porosity of the zone is adjusted to adjust/adapt the suction as the extrados is advanced, the holes of the suction zones 7 being of different dimensions from each other and/or variable porosity.

With the suction an internal pressure $P_{int}$ is created different from the external pressure $P_{ext}$, the arrows indicating the direction of the flow of air absorbed from the boundary layer (air layer very close to the surface of the sail).

Figure 8:
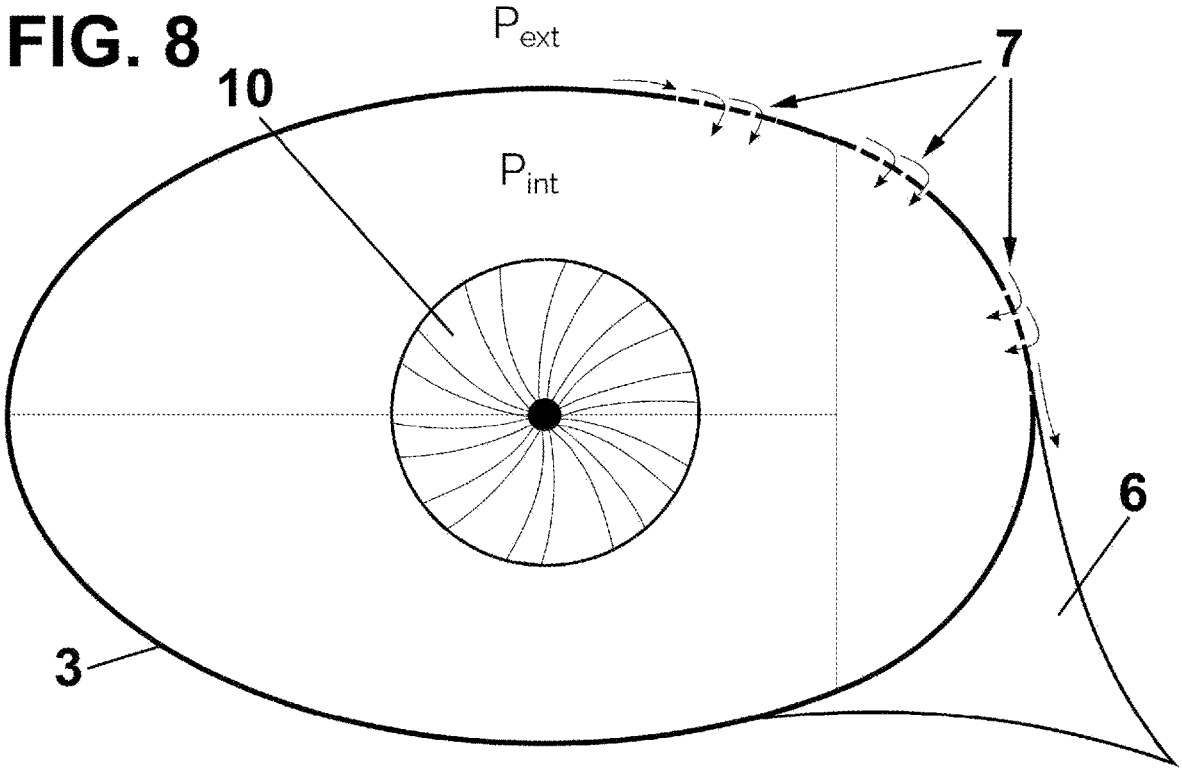

FIG. 8 shows an embodiment that comprises a plurality of suction zones 7, that is, sections provided with holes separated from each other, which allows greater control over the suction.

It should be noted that these suction zones 7 extend over the entire height of the sail.

Figure 9:
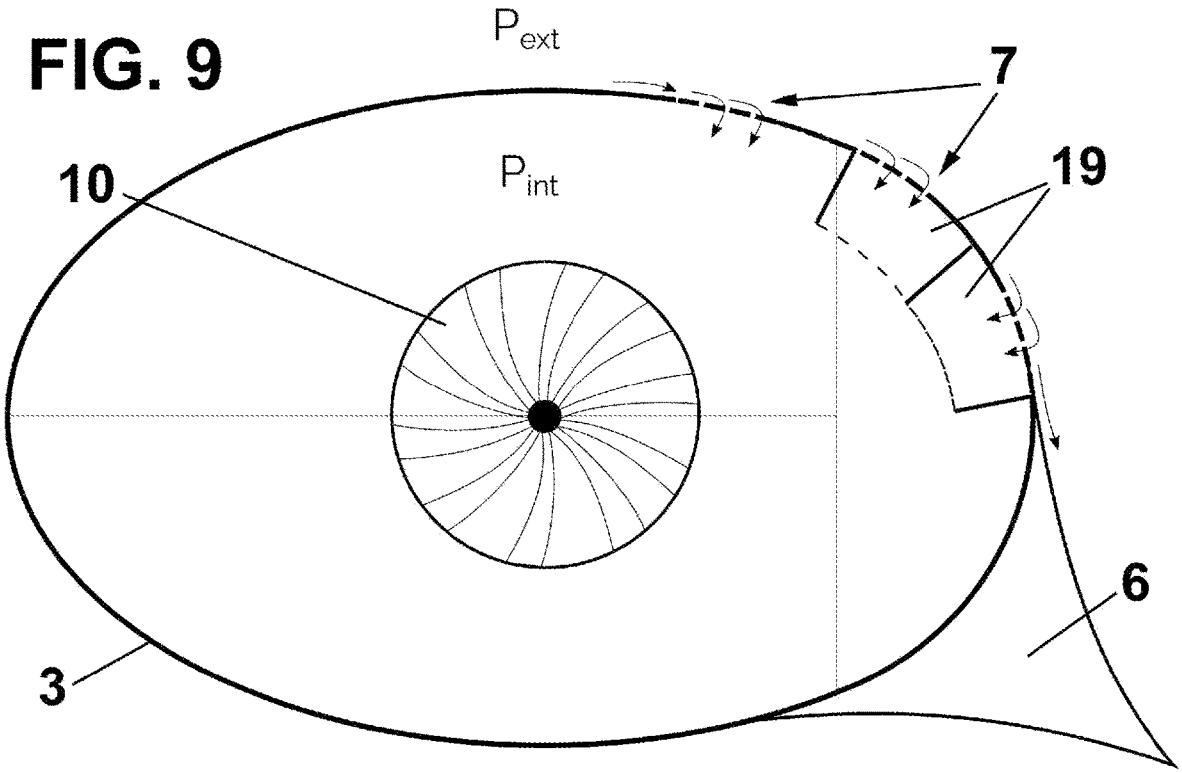

FIG. 9 shows an embodiment that comprises a single suction zone 7, but divided into different housings 19, which form the variable suction means, and which may be different, for example, with different permeabilities (size and number of holes). In this way, by sucking centrally, different suction levels (or pressures) are generated in each section 19 and thus have greater suction control.

Figure 10:
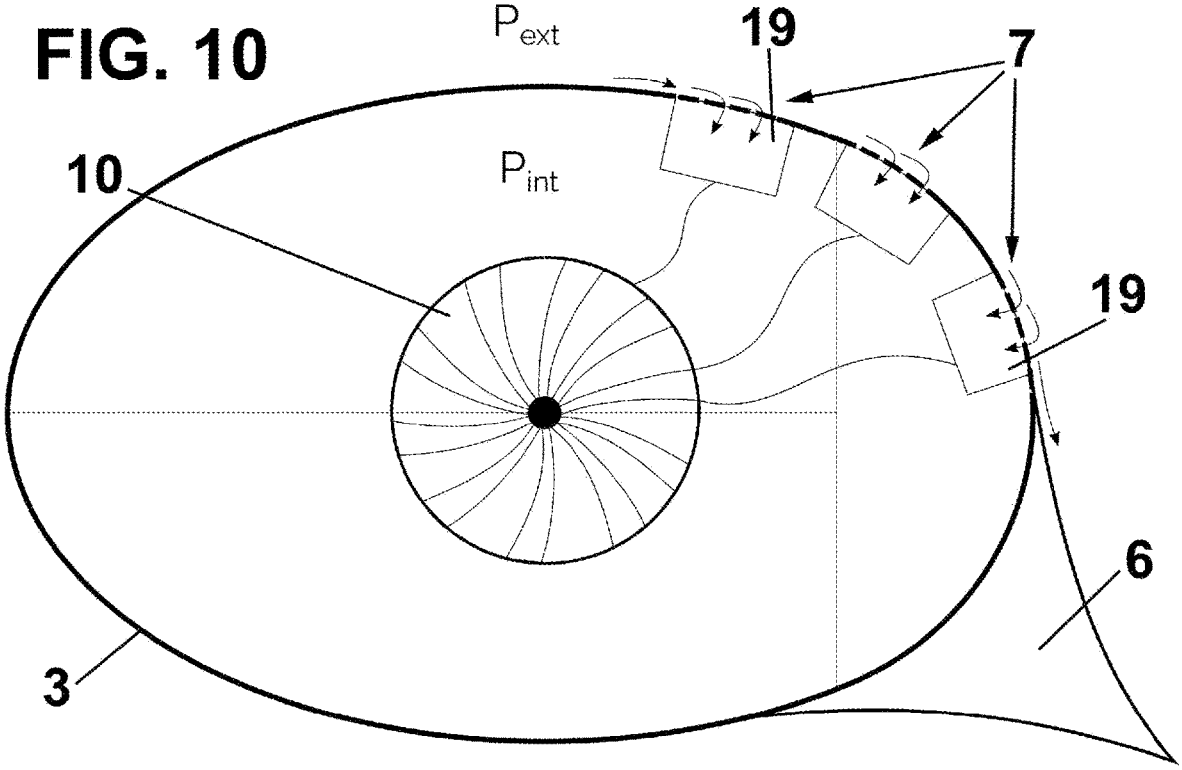

FIG. 10 shows an embodiment comprising different suction zones 7 and housings 19, the suction zones 7 being separated from each other, allowing better control of each zone.

Figure 11:
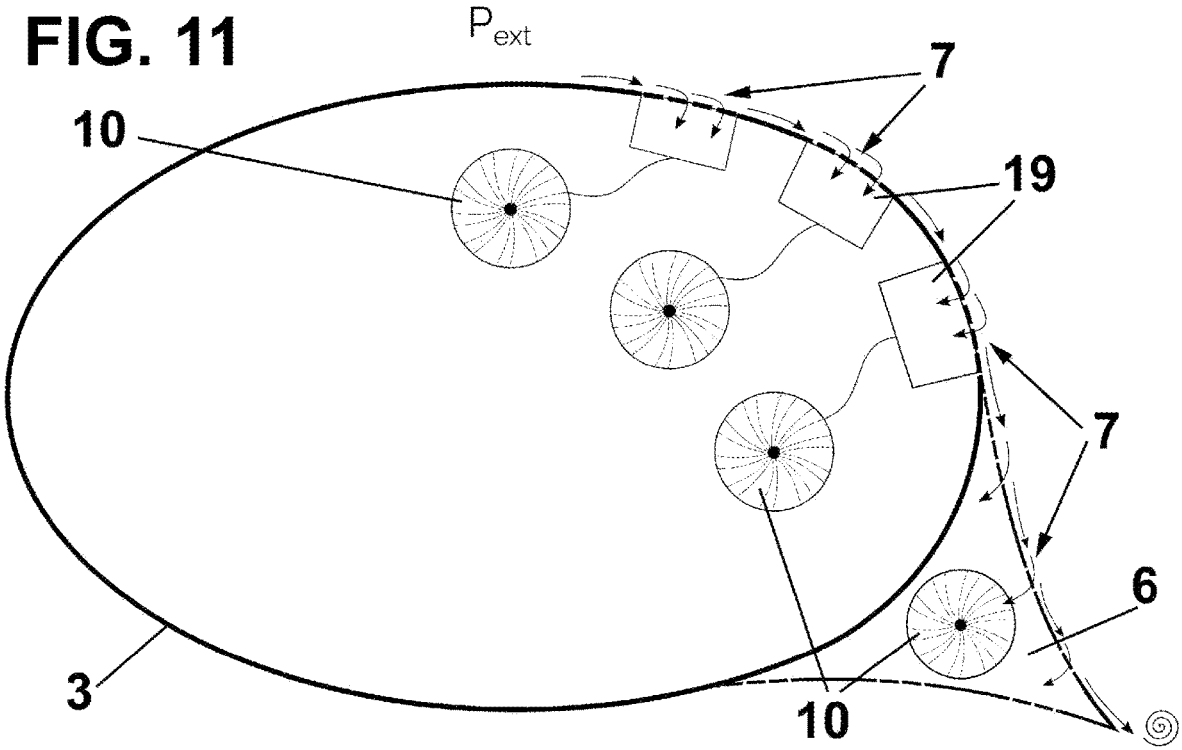

FIG. 11 shows another embodiment, which is very similar to the previous one, with the difference that each housing 19 can be sucked independently with independent suction systems 10.

Figure 12:
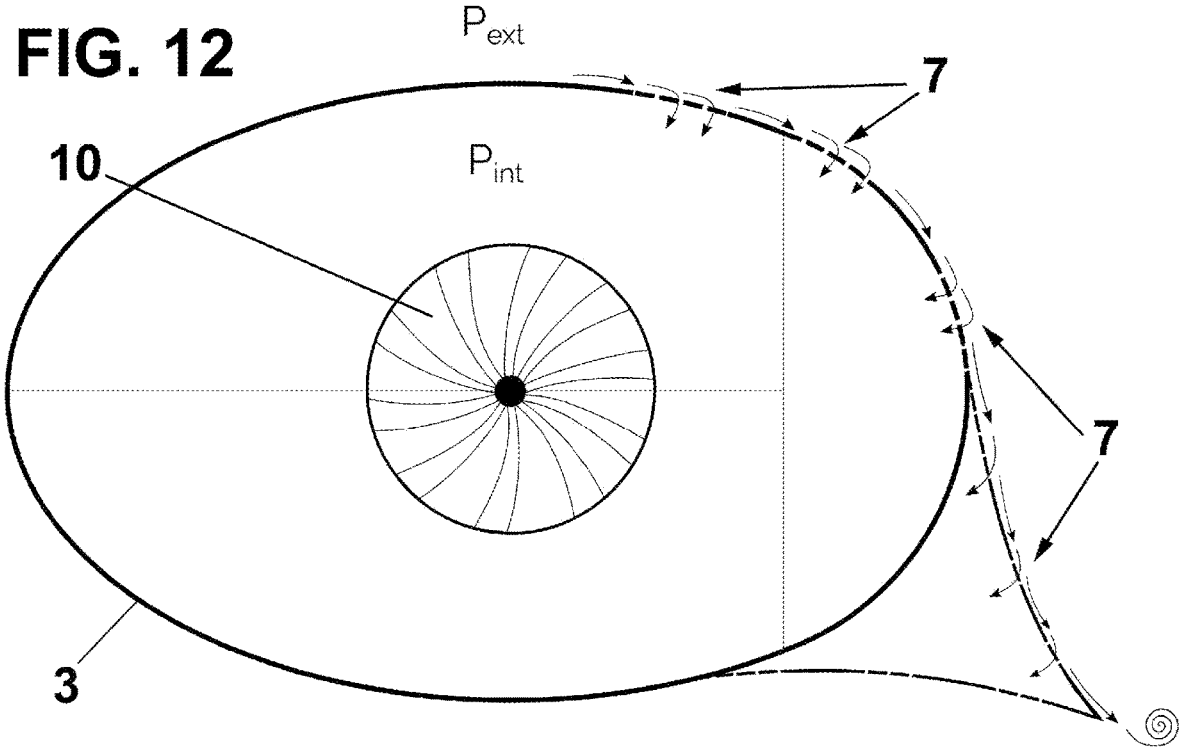

In the embodiment shown in FIG. 12, the flap 6 comprises a suction zone 7, which also extends in the entire height.

It should be noted that the suction zone 7 on the flap 6 may be included in any of the embodiments described herein, and that the flap 6 may comprise two or more suction zones 7.

Figure 13:
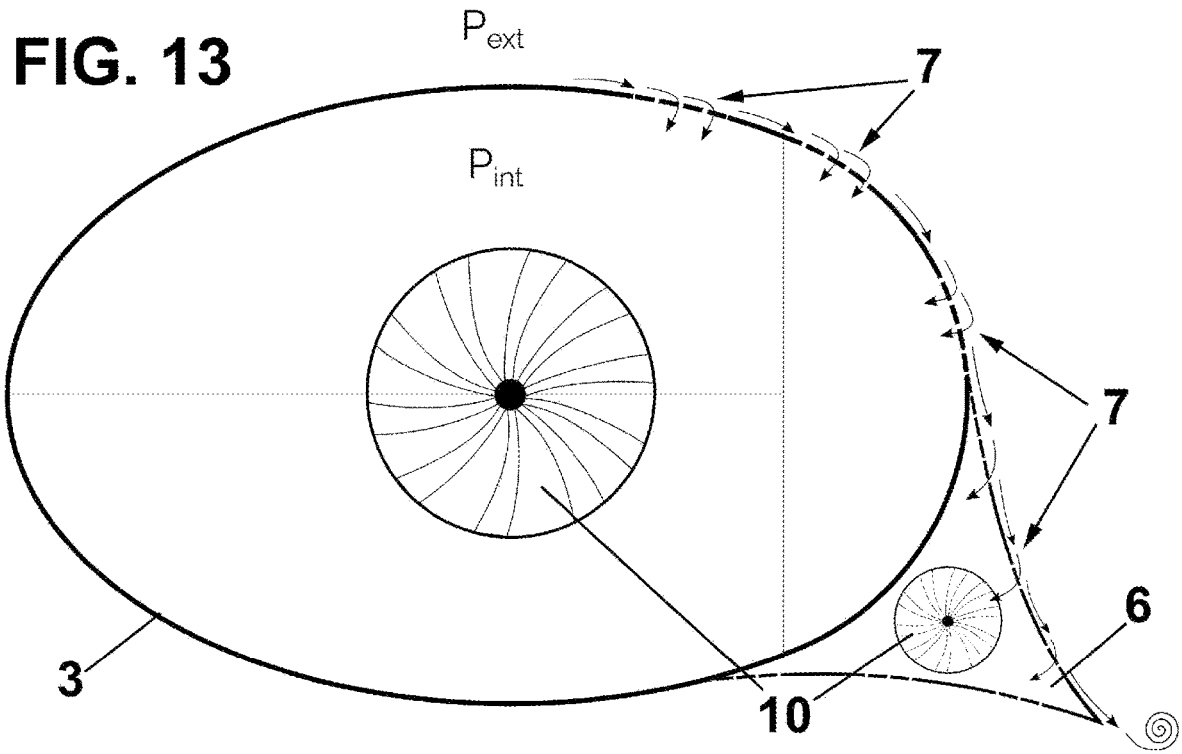

The embodiment of FIG. 13 is a variation of the previous embodiment, with the difference that a suction system 10 is included inside the flap 6 for the suction area 7 of the flap 6 itself.

Figure 14:
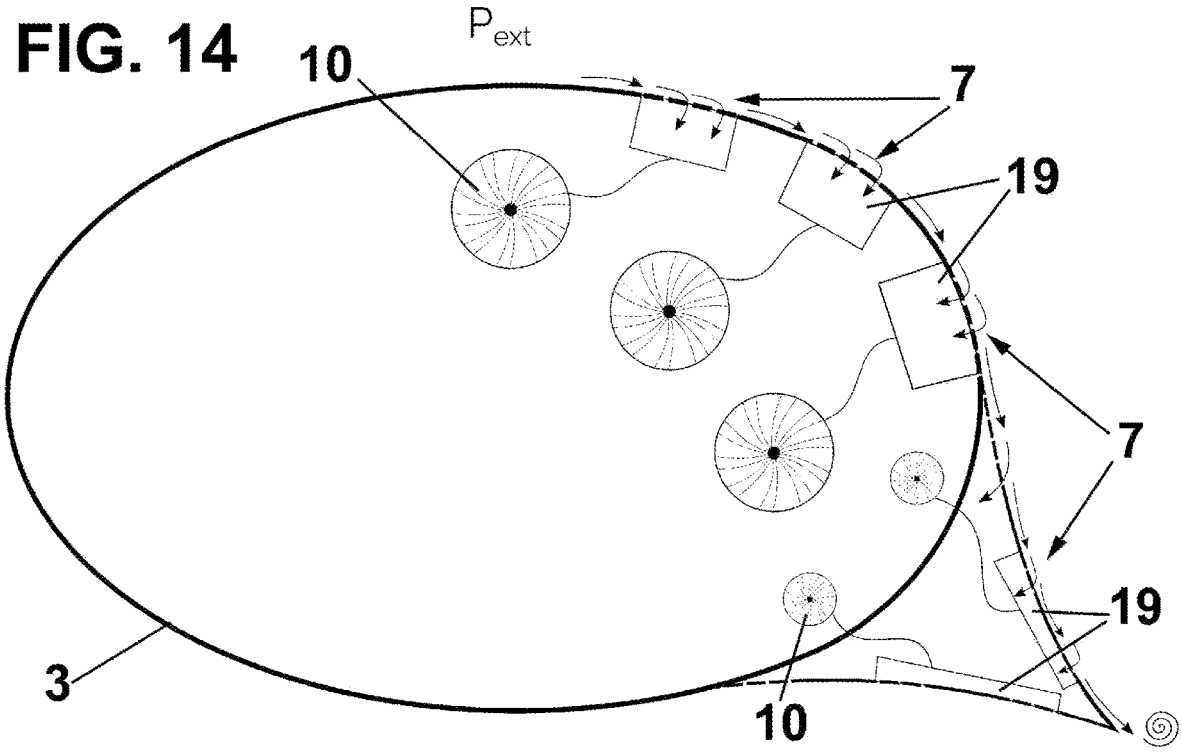

Finally, in the embodiment of FIG. 14, the suction zone 7 of the flap 6 can also comprise one or more housings 19, each one associated with a suction system 10.

It should be noted that there may be sealing means on one side of the flap 6, while the other is operational, for example.

It should also be noted that, for all the above embodiments, the suction sails 3 are symmetrical, that is, when it has been described that there are one or more suction zones 7 on one side, they are also on the other, not only on one side.

Although reference has been made to specific embodiments of the invention, it is apparent to a person skilled in the art that the described propulsion system is susceptible of numerous variations and modifications, and that all the details mentioned can be replaced by other technically equivalents, without departing from the scope of protection defined by the appended claims.

The invention claimed is:

1. Propulsion system for vessels, comprising at least one suction sail (3), said at least one suction sail (3) comprising a suction system (10) and a transmission unit (8) to drive the rotation of said suction sail (3), characterized in that the suction sail (3) comprises at least two suction zones (7) arranged symmetrically on two sides of the suction sail (3), said suction zones (7) comprising variable suction means, wherein said variable suction means comprises holes of said suction zones (7) of varying dimensions corresponding to the relative location of said holes along a profile of said suction sail (3).

2. Propulsion system for vessels according to claim 1, wherein said variable suction means further comprises variable porosity.

3. Propulsion system for vessels according to claim 1, wherein said variable suction means comprise a housing (19) in at least one of the suction zones (7), which divides each suction zone (7) into sections.

4. Propulsion system for vessels according to claim 1, in which at least one of the suction zones (7) is arranged on a flap (6).

5. Propulsion system for vessels according to claim 4, wherein the, or each, suction zone (7) arranged in the flap (6) comprises a housing (19).

6. Propulsion system for vessels according to claim 1, comprising more than one suction system (10) associated with different suction zones (7).

7. Propulsion system for vessels according to claim 3, wherein each housing (19) is associated with a suction system (10).

8. Propulsion system for vessels according to claim 4, wherein the suction zone (7) located on the flap (6) comprises its suction system (10) also located on the flap (6).

9. Propulsion system for vessels according to claim 2, in which at least one of the suction zones (7) is arranged on a flap (6).

10. Propulsion system for vessels according to claim 9, wherein the, or each, suction zone (7) arranged in the flap (6) comprises a housing (19).

11. Propulsion system for vessels according to claim 3, in which at least one of the suction zones (7) is arranged on a flap (6).

12. Propulsion system for vessels according to claim 11, wherein the, or each, suction zone (7) arranged in the flap (6) comprises a housing (19).

13. Propulsion system for vessels according to claim 2, comprising more than one suction system (10) associated with different suction zones (7).

14. Propulsion system for vessels according to claim 3, comprising more than one suction system (10) associated with different suction zones (7).

15. Propulsion system for vessels according to claim 4, comprising more than one suction system (10) associated with different suction zones (7).

16. Propulsion system for vessels according to claim 5, comprising more than one suction system (10) associated with different suction zones (7).

17. Propulsion system for vessels according to claim 9, comprising more than one suction system (10) associated with different suction zones (7).

18. Propulsion system for vessels according to claim 10, comprising more than one suction system (10) associated with different suction zones (7).

19. Propulsion system for vessels according to claim 11, comprising more than one suction system (10) associated with different suction zones (7).

20. Propulsion system for vessels according to claim 12, comprising more than one suction system (10) associated with different suction zones (7).

21. Propulsion system for vessels according to claim 5, wherein each housing (19) is associated with a suction system (10).

22. Propulsion system for vessels according to claim 9, wherein the suction zone (7) located on the flap (6) comprises its suction system (10) also located on the flap (6).

23. Propulsion system for vessels according to claim 11, wherein the suction zone (7) located on the flap (6) comprises its suction system (10) also located on the flap (6).

* * * * *